US010829934B2

(12) United States Patent
Louw

(10) Patent No.: US 10,829,934 B2
(45) Date of Patent: Nov. 10, 2020

(54) STRUCTURAL ELEMENT

(71) Applicant: Andries Auret Louw, Pretoria (ZA)

(72) Inventor: Andries Auret Louw, Pretoria (ZA)

( * ) Notice: Subject to any disclaimer, the term of this patent is extended or adjusted under 35 U.S.C. 154(b) by 279 days.

(21) Appl. No.: 16/068,021

(22) PCT Filed: Jan. 14, 2017

(86) PCT No.: PCT/IB2017/050206
§ 371 (c)(1),
(2) Date: Jul. 3, 2018

(87) PCT Pub. No.: WO2017/122181
PCT Pub. Date: Jul. 20, 2017

(65) Prior Publication Data

US 2020/0270865 A1 Aug. 27, 2020

(30) Foreign Application Priority Data

Jan. 14, 2016 (ZA) ..... 2016/00291

(51) Int. Cl.
*E04C 3/34* (2006.01)
*E04C 3/32* (2006.01)
(Continued)

(52) U.S. Cl.
CPC ..... *E04C 3/34* (2013.01); *E02D 5/30* (2013.01); *E04B 1/165* (2013.01); *E04B 1/21* (2013.01);
(Continued)

(58) Field of Classification Search
CPC ... E04B 1/18; E04B 1/185; E04B 1/20; E04B 1/21; E04B 1/215; E04B 2001/2478;
(Continued)

(56) References Cited

U.S. PATENT DOCUMENTS 1,950,422 A * 3/1934 Wheeler ..... E04B 1/185 52/260
1,977,715 A * 10/1934 Coleman ..... E04C 3/06 52/846
(Continued)

FOREIGN PATENT DOCUMENTS

AT 360738 T 1/1981
CA 2757740 A1 * 5/2013 ..... E04C 5/16
(Continued)

OTHER PUBLICATIONS

International Search Report and Written Opinion from International Application No. PCT/IB2017/050206 dated Apr. 11, 2017.

*Primary Examiner* — Jessie T Fonseca
(74) *Attorney, Agent, or Firm* — Dorsey & Whitney LLP

(57) ABSTRACT

Disclosed is a structural element including of interlocked resilient sheet material components, with each sheet operatively forming a component by being shaped to provide an elongate base with two opposing edges from which a first extension and a second extension respectively extend, with the second extension extending further from the base than the first extension, with the first and second extensions being provided with complimentary interlocking means operatively enabling the extensions of one sheet material component to be interlocked with the extensions of another sheet material component; with the extensions of four sheet components being interlocked, each at a right angle with at least one extension of another one of the sheet components, operatively for four sheet components to provide the structural element with an elongate open-ended core with a plurality of elongate open-ended ribs spaced around the core with each rib being longitudinally aligned with the core.

11 Claims, 11 Drawing Sheets

(51) Int. Cl.

| | |
|---|---|
| ***E04B 1/30*** | (2006.01) |
| ***E04B 1/21*** | (2006.01) |
| ***E04H 12/12*** | (2006.01) |
| ***E02D 5/30*** | (2006.01) |
| ***E04H 12/34*** | (2006.01) |
| ***E04B 1/16*** | (2006.01) |
| *E04B 1/24* | (2006.01) |

(52) U.S. Cl.
CPC ..... *E04B 1/30* (2013.01); *E04C 3/32* (2013.01); *E04H 12/12* (2013.01); *E04H 12/341* (2013.01); *E04B 2001/2478* (2013.01)

(58) Field of Classification Search
CPC ... E04B 1/30; E04B 1/165; E02D 5/30; E04C 3/34; E04H 12/12; E04H 12/341
See application file for complete search history.

(56) References Cited

U.S. PATENT DOCUMENTS

| | | | | | |
|---|---|---|---|---|---|
| 2,535,263 | A * | 12/1950 | Budne | E04B 1/215 | 403/173 |
| 3,167,841 | A | 2/1965 | Edelbert | | |
| 5,170,598 | A * | 12/1992 | Kadar | E04B 1/165 | 261/DIG. 11 |
| 5,263,297 | A * | 11/1993 | Kim | E04C 3/34 | 52/244 |
| 8,511,043 | B2 * | 8/2013 | Fyfe | E02D 5/226 | 52/223.14 |
| 9,856,647 | B1 * | 1/2018 | Kim | E04B 1/943 | |
| 2009/0282753 | A1 * | 11/2009 | Kuan | E04C 5/0609 | 52/167.1 |
| 2014/0007543 | A1 * | 1/2014 | Adel | F41H 5/24 | 52/741.1 |

FOREIGN PATENT DOCUMENTS

| | | | | | |
|---|---|---|---|---|---|
| DE | 1267822 | B * | 5/1968 | E04C 3/28 | |
| DE | 2302851 | A1 | 7/1974 | | |
| DE | 3041931 | A1 * | 5/1982 | E04H 7/30 | |
| DE | 8913019 | | 4/1991 | | |
| DE | 10157581 | A1 | 6/2003 | | |
| FR | 2410716 | A1 | 6/1979 | | |
| WO | WO-2010091453 | A1 * | 8/2010 | E04C 3/32 | |
| WO | 2012083391 | A1 | 6/2012 | | |

* cited by examiner

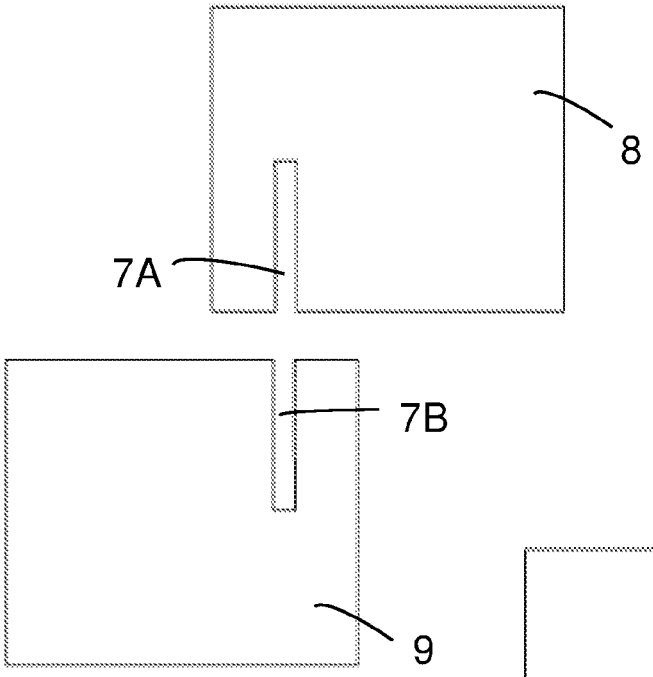
FIGURE 3A-1
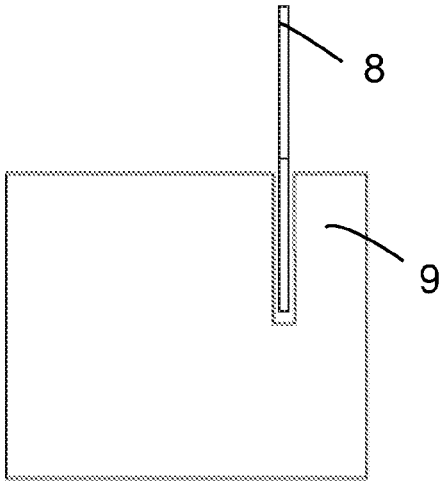
FIGURE 3A-2
FIGURE 3B
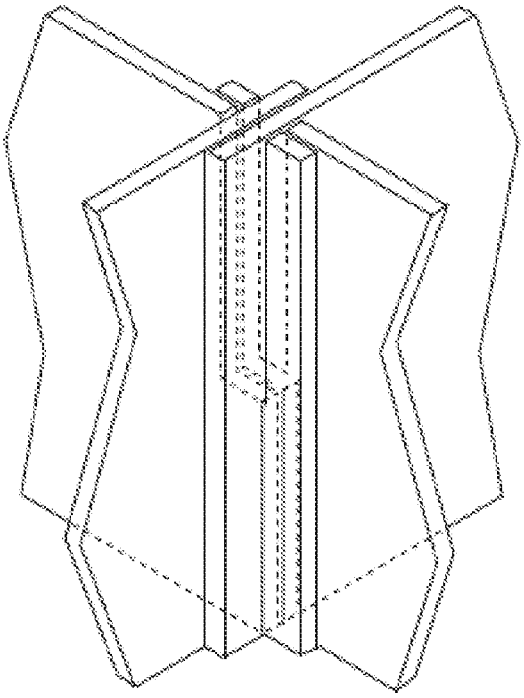

FIGURE 5A
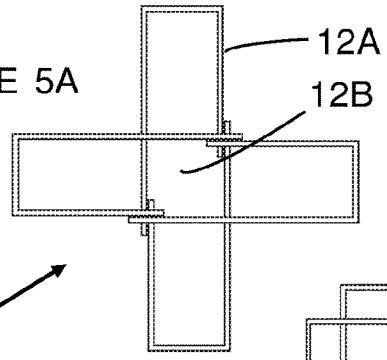
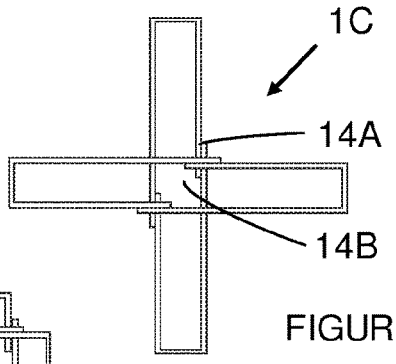
FIGURE 5C
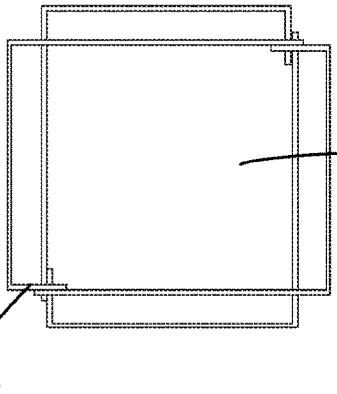
FIGURE 5B
FIGURE 6A
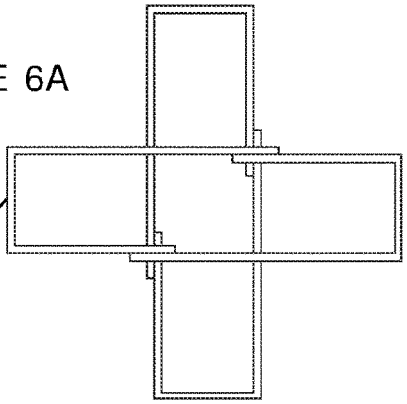
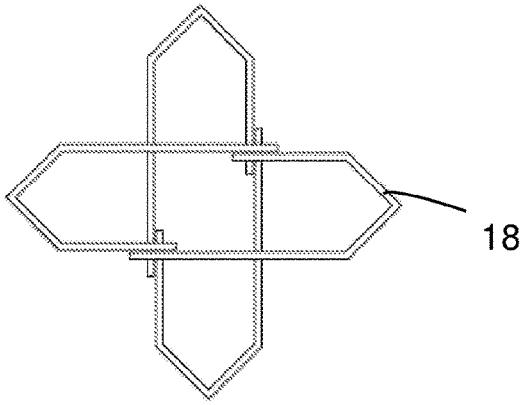
FIGURE 6C
FIGURE 6B
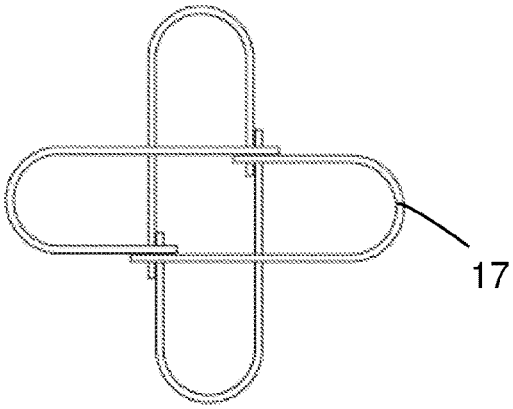

FIGURE 9A
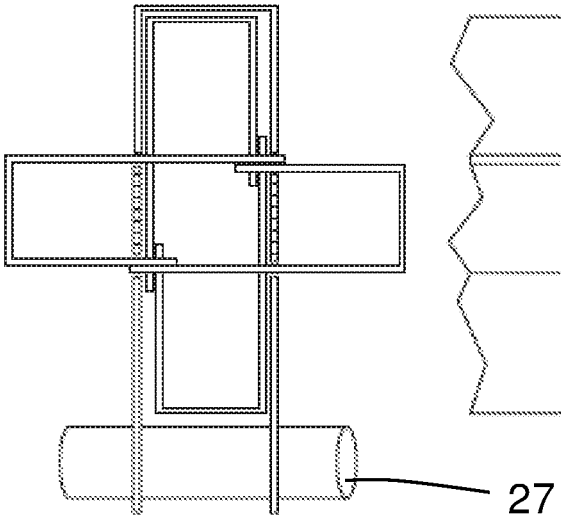
FIGURE 9B
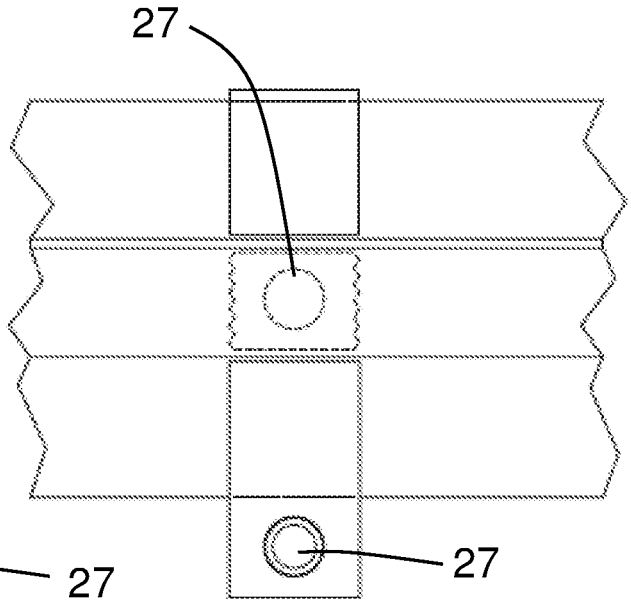
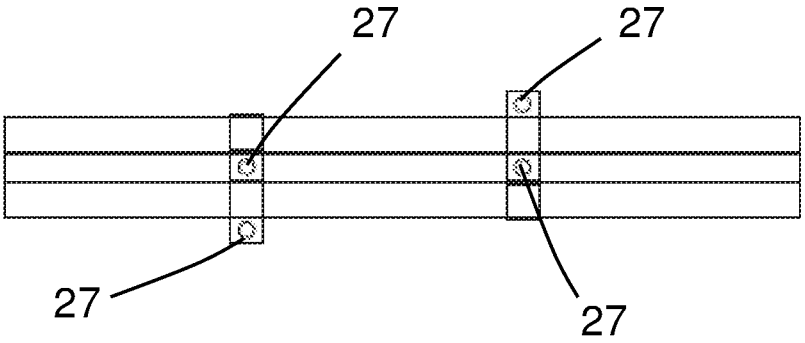
FIGURE 9C

STRUCTURAL ELEMENT

FIELD OF THE INVENTION

This invention relates to a structural element, such as beams and columns.

BACKGROUND TO THE INVENTION

In the structural engineering industry the relative advantages of concrete-filled steel tubes (CFST) over a concrete pillar or a steel tube has been well established and proven over many years. Especially in China and more recently in India, this type of support pillar, column or beam has been used extensively in the construction of structures such as bridges and buildings.

Concrete-filled steel tubes (CFSTs) have increased point strength, axial strength, stiffness, torsional strength, shearing strength and buckling or deformability resistance relative to comparably sized reinforced concrete columns. The steel is at its optimal location, as far from the centroid as possible where it maximizes strength and stiffness while minimizing weight and material requirements, while it provides confinement to the concrete infill which cannot move out of its position until the steel sheathing shears to allow it to move outside of the confinement. In turn, the infill takes up the space inside the tube, thereby resisting or delaying local and global buckling of the tube. In addition to their high resistance and stiffness properties, CFSTs can easily and rapidly be constructed on-site, or pre-made under controlled conditions, thereby eliminating the need for formwork, reinforcement and labour.

Despite all the clear benefits of CFSTs, global adoption is slow due to some concerns and shortcomings of this type of tube based pillar structure that are difficult to overcome, which shortcomings include:

- It is expensive to custom manufacture tubes, so it is expensive to manufacture a specific tube where specific sizes, shapes, outer steel skin thicknesses and steel qualities are required;
- Whenever tubes are custom made according to a specifically required specification, the quality of the steel binding is very difficult to control and consistently maintain when welding or bolts are used;
- Hollow tubes are not compact and contain a lot of space, so it is expensive to transport them to site when they are hollow (to be filled with concrete at site) and very expensive to transport when they are filled with concrete before the time and then moved to site;
- For optimal performance the steel and concrete should bind and adhere as a single structure, as with concrete and rebar where the rebar is made to have an uneven surface to facilitate the binding, but with the flat inner surfaces of tubes this is not easy to achieve and the concrete tends to separate from the tube surface over time, thereby potentially changing the characteristics of the overall structure; and
- It is very difficult to attach binds that are as strong as the rest of the CFST to the CSFT that can be used to attach other structures and objects to the CFST. This is due to the fact that:
  - the steel and concrete in a CFST are difficult to bind together, because the inner and outer surfaces of a tube is typically smooth;
  - it is not easy to attach other members to a CFST because welding is difficult to inspect and inevitably not as strong as the rest of the structure; and
  - cutting holes in the tube to insert attachments that bind to the concrete weakens the structure and does not effectively distribute the load.

OBJECTIVE OF THE INVENTION

It is an objective of the invention to provide a structural element which at least partly overcomes the abovementioned problems.

SUMMARY OF THE INVENTION

A structural element comprised of a plurality of interlocked resilient sheet material components, with each sheet operatively forming a component of the structural element by being shaped to provide an elongate base with two opposing edges from which a first extension and a second extension respectively extend, with the second extension extending further from the base than the first extension,

- with the first and second extensions being provided with complimentary interlocking means operatively enabling the extensions of one sheet material component to be interlocked with the extensions of another sheet material component;
- with the extensions of four sheet components being interlocked, each at a right angle with at least one extension of another one of the sheet components,
- operatively for four sheet components to provide the structural element with an elongate open-ended core with a plurality of elongate open-ended ribs spaced around the core with each rib being longitudinally aligned with the core.

There is further provided for the second extension of a first sheet component to be interlocked with and extending at right angles beyond the first and second extensions of a second sheet component,

- with the second extension of the second sheet component being interlocked with and extending at right angles beyond the second and first extensions of the first sheet component, and with the first extension of the second sheet component being interlocked with and extending at right angles beyond the second extension of the first sheet component and the first extension of a third sheet component,
- with the first extension of the third sheet component being interlocked with and extending at right angles beyond the first extension of the second sheet component and the second extension of a fourth sheet component, and with the second extension of the third sheet component being interlocked with and extending at right angles beyond the second and first extensions of the fourth sheet component, and
- with the second extension of the fourth sheet component being interlocked with and extending at right angles beyond the second and first extensions of the third sheet component, and with the first extension of the fourth sheet component being interlocked with and extending at right angles beyond the second extension of the third sheet component and the first extension of a first sheet component.

There is further provided for the height of each rib to be variable by varying the lengths of the first and second extensions of the respective sheet component, and for the width of the rib to be variable by varying the length of the bases of opposing sheet components.

In accordance with a further aspect of this invention there is provided each of the first and the second extensions to terminate in an edge provided with a series of spaced apart tabs and slots, with the tabs of the first extension being located longitudinally opposite the slots of the second extension and with the tabs of the second extension being located longitudinally opposite the slots of the first extension, and with the tabs of the second extension being longer than the tabs of the first extension for the second extension to extend further from the base than the first extension;

with the second extension tabs of a first sheet component of the structural element extending at right angles through and interlocked with the first extension slots of a second sheet component of the structural element, and with the second extension tabs of the second sheet component of the structural element extending at right angles through and being interlocked with the first extension slots of a third sheet component of the structural element; and with the second extension tabs of the third sheet component of the structural element extending at right angles through and being interlocked with the first extension slots of a fourth sheet component of the structural element, and with the second extension tabs of the fourth sheet component of the structural element extending at right angles through and being interlocked with the first extension slots of the first sheet component of the structural element;

operatively for the four sheet components to provide the structural element with an elongate open-ended core with a plurality of elongate open-ended ribs spaced around the core with each rib being longitudinally aligned with the core, and with the core being in fluid communication with the interior of the ribs by the spaces between the spaced apart second extension tabs extending through the respective first extension slots.

There is further provided for the tabs of the second extension to be about as long, but no longer than, the width of the base of the sheet material component through which slots it is operatively extended and interlocked with.

There is still further provided for the core and ribs to be filled with a filler material, preferably a cementitious filler, and more preferably for the resilient material to comprise steel, and for the filler material to comprise concrete.

There is also provided for the core to be shaped in the form of a column, preferably a right square column, and each rib comprises a column, including a right square column or a right rectangular column.

There is still further provided for the interlocking means to include any one or more of a slot, welding, riveting, gluing, encircling securing members, or retaining members extending through opposing sheet material components.

These and other features of the invention are described in more detail below.

BRIEF DESCRIPTION OF THE DRAWINGS

A preferred embodiment of the invention is described by way of example only and with reference to the accompanying drawings in which:

FIG. 3A is a graphical representation of the range of interlocking grooves of the panels forming part of the structural element of FIG. 1 where they interlock into each other, with FIG. 3A-1 indicating an exploded view and FIG. 3A-2 an assembled view;

FIG. 3B graphically indicates how the interlocking grooves of FIG. 3A are used to interlock four panels at a single point;

FIG. 5 indicates graphically by altering the length of the arms, the characteristics of the structural element of FIG. 1 can be changed to fit the purpose, with FIG. 5A indicating a balanced cross column, FIG. 5B indicating a heavy cross column, and FIG. 5C indicating a light cross column;

FIG. 6 indicates graphically the different bending patterns can be used at the protruding ends of the components to give different characteristics or structural or aesthetic or interlinking capabilities to the structural element of FIG. 1, with FIG. 6A indicating a component with square ended ribs, FIG. 6B a component with round ended ribs, and FIG. 6C a component with triangular ended ribs;

FIG. 9 indicates graphically that attachment pieces that adheres to the rest of the structural element of FIG. 1 can be interwoven with the rest of the structure to attach other objects or structures to it, with FIG. 9A indicating a plan view, FIG. 9B indicating a side elevation view of the element, and FIG. 9C a side elevation view of the element with two connectors attached to it;

DETAILED DESCRIPTION OF THE INVENTION

A first embodiment of a structural element according to the invention, and the principles of securing the element components, are shown in FIGS. 1 to 9. A second embodiment of a structural element according to the invention is shown in FIGS. 10 to 14.

Figure 1:
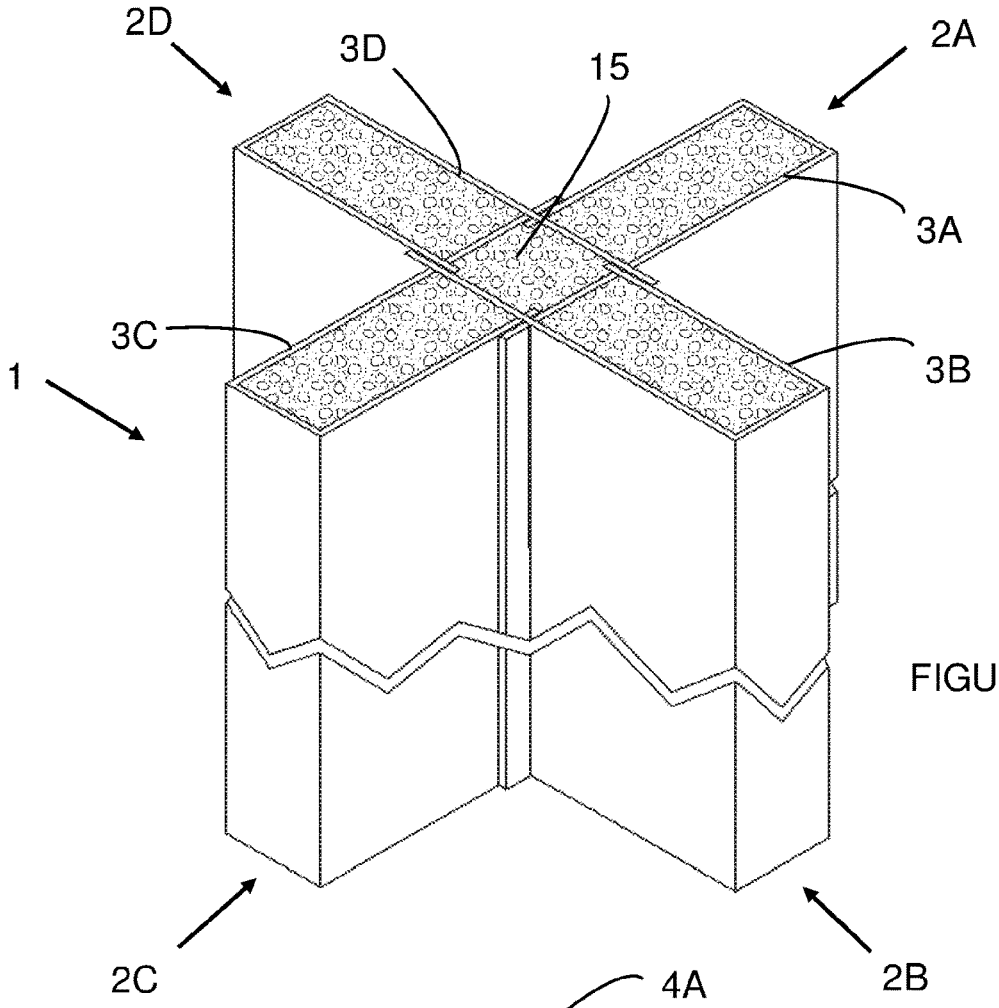
FIG. 1 is a graphical representation of the typical shape of a first embodiment of a structural element according to the invention, in the form of an X-shaped concrete filled steel column ("XCFC column")
Figure 2:
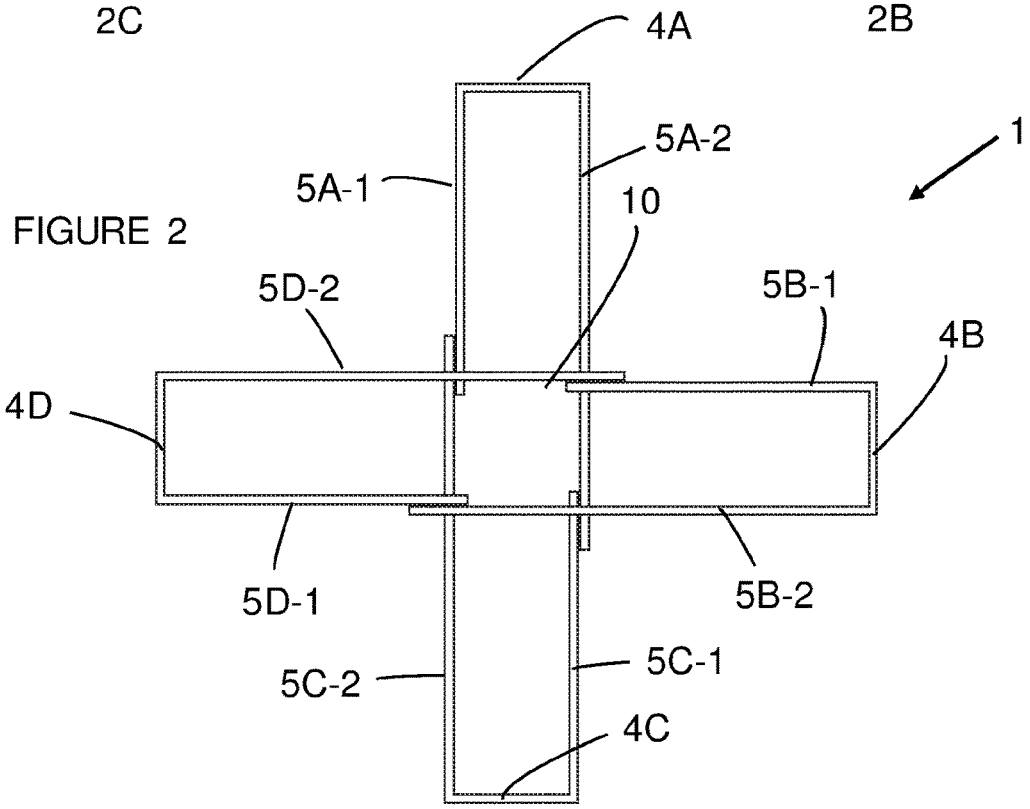
FIG. 2 is an end view of the structural element of FIG. 1.

The first embodiment of the structural element (1), as shown in detail in FIGS. 1 and 2, is comprised of a plurality of interlocked resilient sheet material components (2A-D). Each component is formed from a sheet (3A-D) by being shaped to provide an elongate base (4A-D) with two opposing edges from which a first extension (5A-1, 5B-1, 5C-1, 5D-1) and a second extension (6A-2, 6B-2, 6C-2, 6D-2) respectively extend, with the respective second extension (6A-2, 6B-2, 6C-2, 6D-2) extending further from the respective base (4A-D) than the respective first extension (5A-1, 5B-1, 5C-1, 5D-1).

Figure 3C:
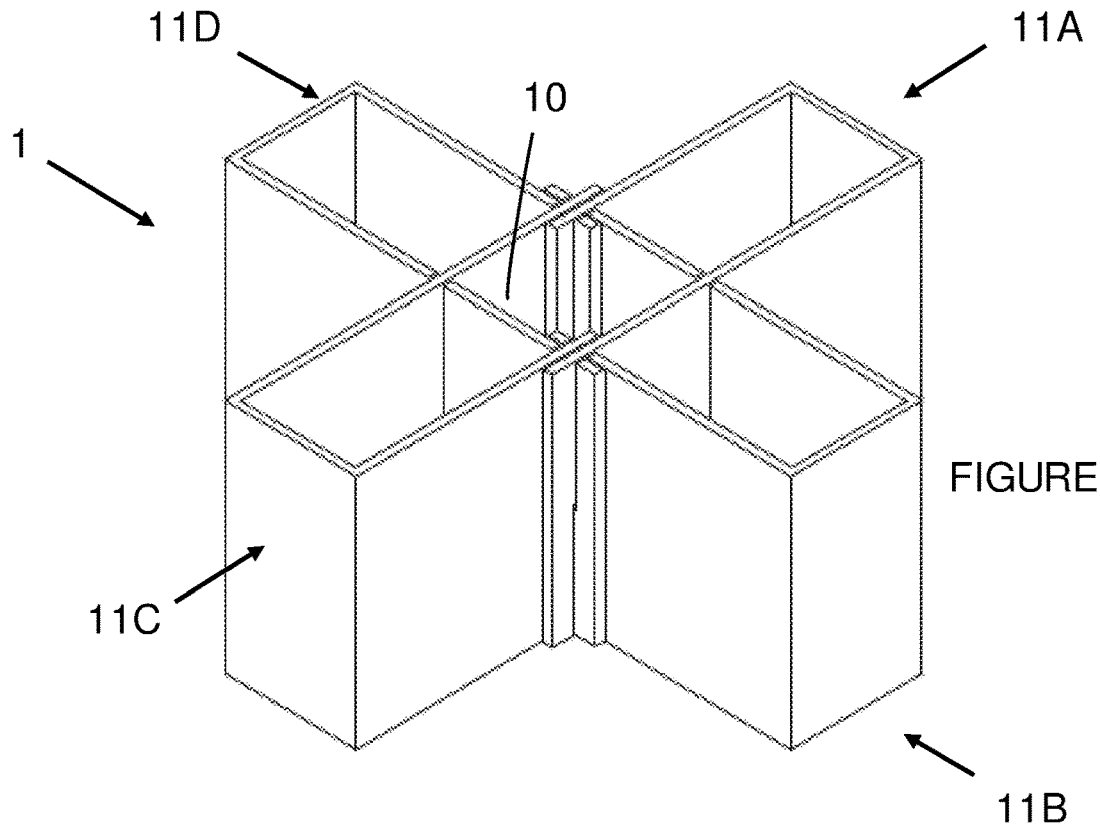
FIG. 3C graphically indicates how in the structural element of FIG. 1 the four panels have four interlocking seams where each of the four panels interlocks along at least 3 seams.

As shown in FIG. 3 the first (5A-1, 5B-1, 5C-1, 5D-1) and second (6A-2, 6B-2, 6C-2, 6D-2) extensions are provided with complimentary interlocking means, in this embodiment in the form of slots (7). As shown in FIG. 3A, this enables the extensions of one sheet material component (8) to be interlocked with the extensions of another sheet material component (9).

In the structural element the extensions of four sheet components are interlocked, each at a right angle with at least one extension of another one of the sheet components, as shown in more detail in FIG. 3B. The four sheet components (2) thus provide the structural element (1) with an elongate open-ended core (10) with a plurality of elongate open-ended ribs (11A-D) spaced around the core with each rib (11A-D) being longitudinally aligned with the core (10).

The interlocking of the components (2A-D) thus form the core (10) and locate the ribs (11A-D) in relation to the core (10). In use, the core (10) and the ribs (11A-D) are filled with a cementitious filler, typically concrete. The components (2A-D) are typically formed from steel sheet.

The structural element (1) thus provides an X-shaped concrete filled steel column (XCFC). The precise shape and pattern of the components (2A-D) can be customised to meet different needs while the steel grade, hardness, tensile strength, yield strength, thickness and other properties can be selected based on what sheet metal can be sourced.

Figure 4:
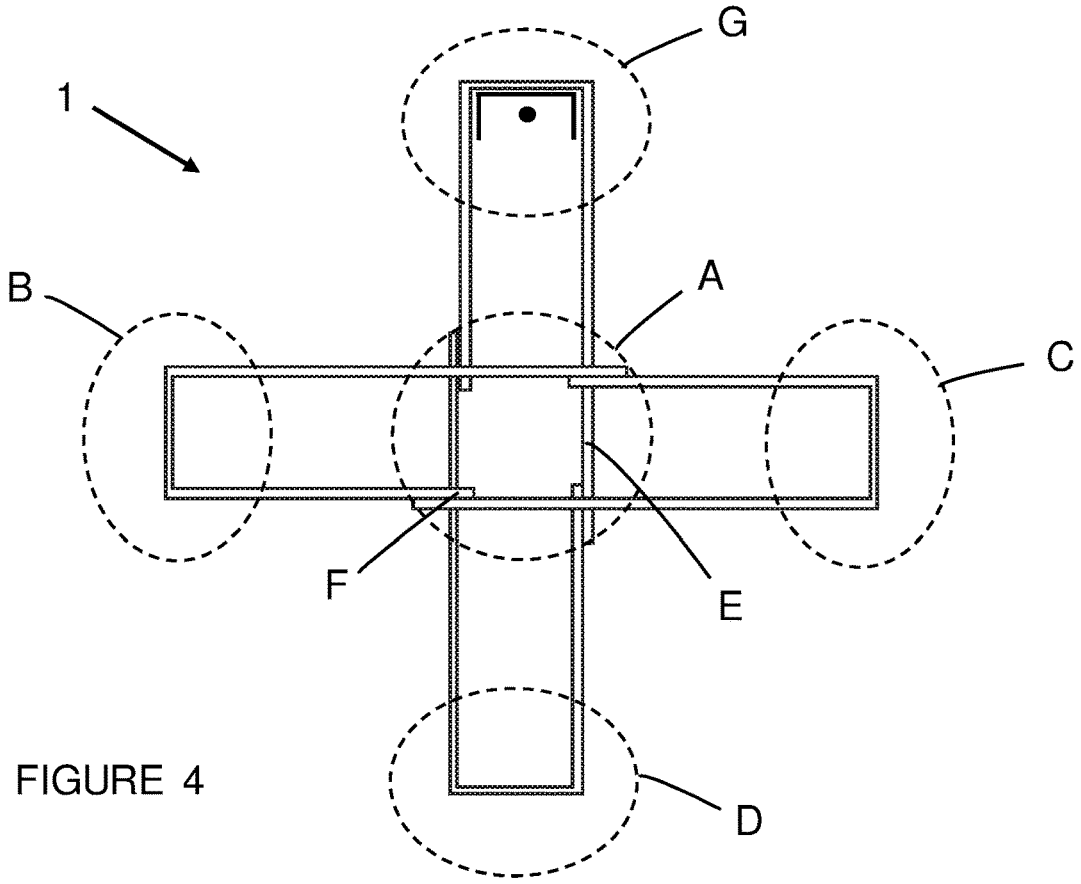
FIG. 4 is a graphical representation of seven distinguishing features of the structural element shown in FIG. 1.

FIG. 4 indicates seven distinguishing features of the structural element (1) shown in FIG. 1. These include:

Feature "A": the cross section consists of 4 interlocking sections where each component interlocks with at least 3 interlocking seams;

Feature "B": the ends can consist of two or more bended sections, and even a half circle, together completing a 90 degree curve before it joins the intersection;

Feature "C": the four ends need not be the same type (one can be a half circle and others can for instance be bent at two or more places);

Feature "D": the four ends can be of different lengths;

Feature "E": the interlocking section of the components forms a binding mesh for the concrete and steel to bind together;

Feature "F": the component slide into place to interlock without requiring the use of screws or welding; and Feature "G": reinforcing members and stressed steel support members may be added to selected areas.

By customising the cutting pattern, the thickness of each of the extensions of the column can be determined on a case by case basis, thereby determining the relative strength of the arms and the structure as a whole.

The length of each of the extensions can similarly be customised, thereby determining the relative strength of the structural element (1) in different directions when applying different forces to it. This is indicated in FIG. 5, in which it is shown how the width and length of the four ribs (11A-D) and the core (10) of the structural element (1) can be changed as per the design parameters of the engineer or architect by altering the length of the extensions (12-14).

A balanced cross column structural element (1A) is shown in FIG. 5A, with its extensions (12) being of similar length than the length and width of its core (12B).

FIG. 5B shows a heavy cross column structural element (1B), with its extensions (13A) being much shorter than the length and width of its core (13B), and its core (13B) also being larger than the core (12B) of the balanced cross column structural element (1A) shown in FIG. 5A.

FIG. 5C shows a light cross column structural element (10), its extensions (14A) being much longer than the length and width of its core (14B), and its core (14B) being smaller than the cores (12B, 13B) of structural elements (1A, 1B) shown in FIGS. 5A and 5B.

As shown in FIG. 6, different bending patterns can be used at the protruding ends of the components (16-18) to give different characteristics or structural or aesthetic or interlinking capabilities to the structural element of FIG. 1. FIG. 6A indicates a component (16) with square ended ribs, FIG. 6B a component (17) with round ended ribs, and FIG. 6C a component (18) with triangular ended ribs.

For each structural element (1) its four components are joined together at the central axis of the resulting four-ribbed structural element (1) in such a manner that they interlock with each other, thereby forming a uniform and uninterrupted outside steel skin and an interlocked meshed internal core structure. Once concrete (15) is poured into the steel frame of the structural element (1), the concrete (15) can solidly bind with the meshed internal steel core of the structural element (1) and its interlocking components, thereby not only securing the bind between the concrete and the steel but also solidifying the interlocked lines where the steel components are bound to each other. By positioning these four lines where the interlocking between the four components (2A-D) takes place, close to the centre of the structural element (1) where forces are far less than on the outside thereof where the forces are maximised, stress on the interlocking lines are further minimised while the need for welding and bolts are negated.

For increased strength, extra re-enforcing members, including pre-stressed and post-stressed steel cables and rods as well as reinforcing ties can be added to the inner core of any or all of the extensions in order to change the characteristics of structural element (1) when applying different forces to it. This enables the engineer, designer or architect to use the same basic design and manufacturing process to create structural elements in the form of pillars, columns, plinths and beams with characteristics designed to handle the specific axial load, point load, distributed load, torsional and shear forces it is designed to withstand for the specific application it is to be used for.

Figure 7:
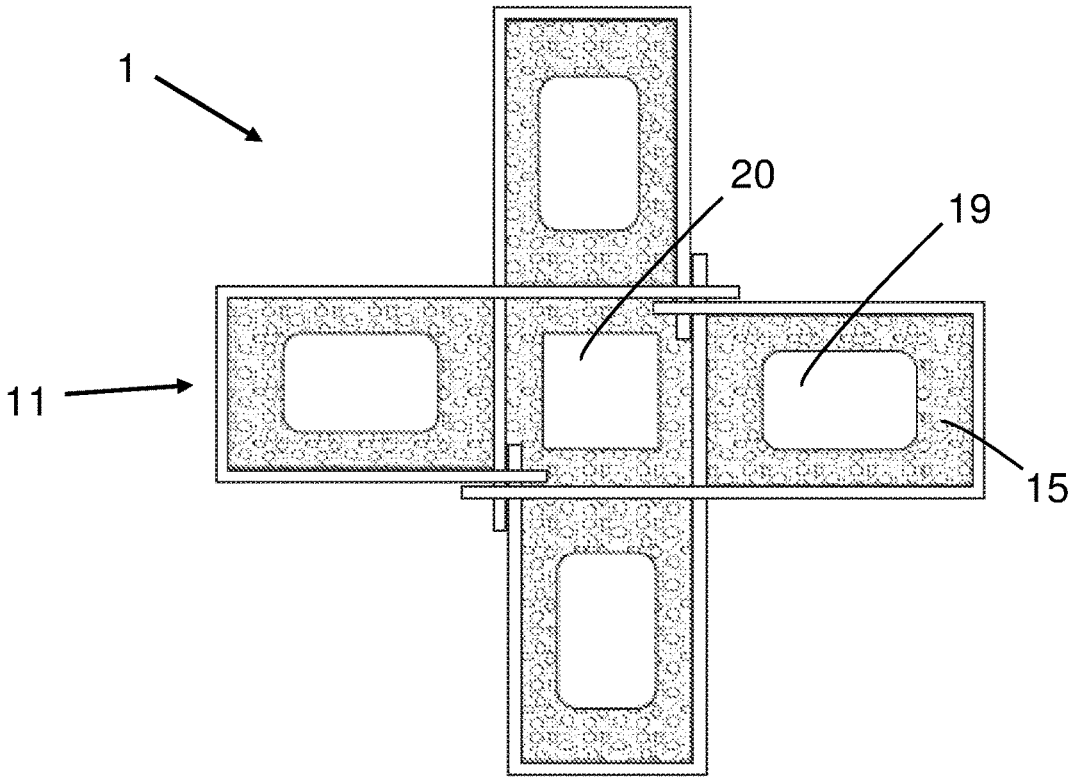
FIG. 7 indicates graphically that the concrete in the structural element of FIG. 1 does not have to be solid, but can have air pockets in them to lower weight or cost.

As shown in FIG. 7 the structural element (1) that is filled with concrete (15) not have to be solid, but can have air pockets (19-20) that are located in or extend through the core (10) and/or ribs (11) in them to lower weight or cost.

Figure 8:
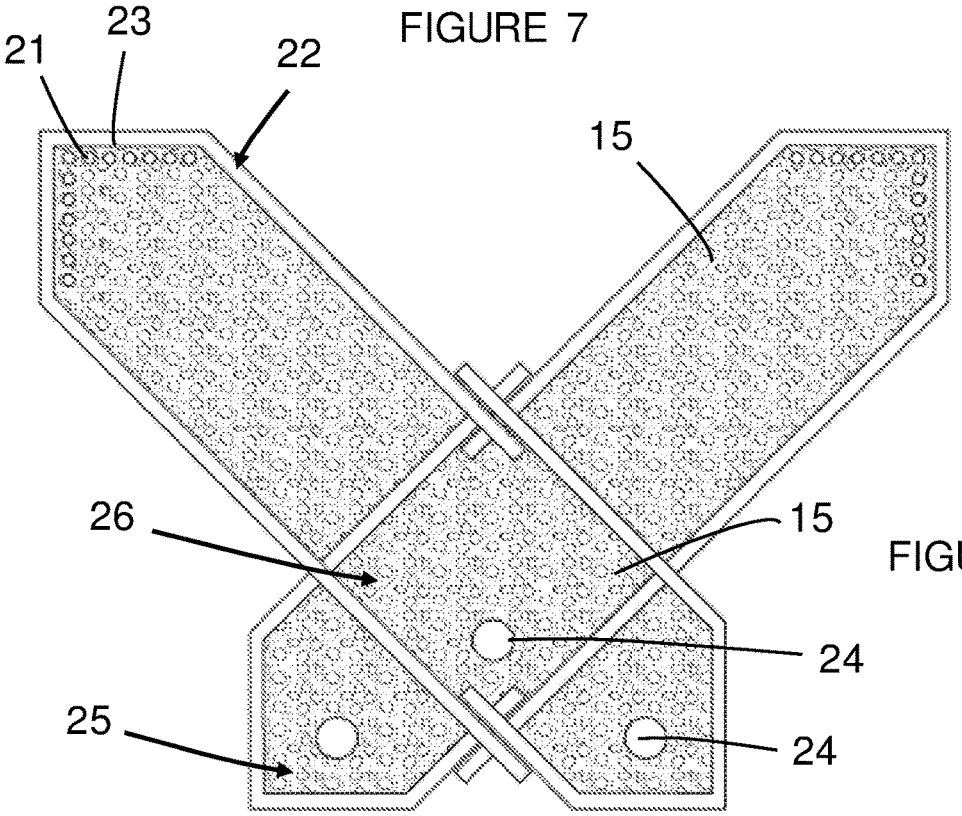
FIG. 8 indicates graphically that by selectively adding re-enforcing members or cable where needed, the structural element of FIG. 1 can easily be designed and built for purpose.

As shown in FIG. 8, in order to strengthen the outer section of an extension of the structural element (1) where the forces are greatest once load is applied to it, a 90 degree bent steel V-section (21) can for instance be added to the inside of the outer sections of an the extension (22) where the concrete, once added, will push it against the inside (23) of the steel skin of the extension (22).

Similarly, and also shown in FIG. 8, when used as a beam, one or more hollow tubes (24) can be inserted into the internal cavity of the bottom extension (25) of such a beam, or the bottom of the core (26), through which post stressing cables can be strung and tensioned to provide a post stressed beam section. A steel V-section can even be added to the top one or two extensions of a beam to strengthen those sections from buckling while post-stressed cables are added to the bottom one or two extensions, as shown in FIG. 8.

As shown in FIG. 9, to attach binds to the structural element (1) that adhere to it and can be used to attach other structures or objects to the structural element (1), one or more attachment bands or attachment binds (27) can be interwoven with the core along with one or more of the four extensions of the structural element (1). By doing this, the attachment band or attachment bind (27) does not weaken the structure in any way, while it can be interlocked with the steel structure and bound to the concrete using rough edges where it is interwoven with the concrete, making the bind adhere to the structural element (1) without weakening it or the attachment piece itself.

Common fabrication tools such as plasma or laser cutters and bench press benders can be used to fabricate the structural element (1), thereby making the fabrication process easy and the very cost effective, even when customising the standard cutting patterns that can be issued for the invention.

By cost effectively giving the engineer, designer or architect the freedom to select column width and thickness, steel grade, properties, strength, thickness, hardness and corrosive properties, and then making it easy to adapt the standard designs to suit the customised requirement, the engineer, designer or architect is given the freedom to design the concrete filled steel column structural element (1) according to the needs of the overall design and not based on what tube sizes, shapes, wall thicknesses and steel grades are available in the market at the time.

The second embodiment of a structural element (30) according to the invention is shown in FIGS. 10-14. In this instance the structural element (30) is comprised of four sheet components, each of which includes first (31) and the second (32) extensions that extend from a base (33). Each of the first (31) and the second (32) extensions terminate in an edge that is provided with a series of spaced apart tabs (34, 35) and slots (36, 37).

The tabs (34) of each first extension (31) are located longitudinally opposite the slots (37) of its second extension (32) and the tabs (35) of its second extension (32) are located longitudinally opposite the slots (36) of its first extension (31). The tabs (35) of the second extension (32) are longer than the tabs (34) of the first extension (31), which enables in respect of each sheet component (30) the second extension (32) to extend further from the base (33) than its first extension (31).

As shown in FIGS. 10 and 11 the bases (33) of the components may have custom shapes, for example square (33A) or triangular (33B). Other shapes, for example round, are also possible.

To manufacture the sheet component common fabrication tools such as plasma or laser cutters and bench press benders can be used to fabricate the structural element (30), thereby making the fabrication process easy and the very cost effective, even when customising the standard cutting patterns that can be issued for the invention.

By cost effectively giving the engineer, designer or architect the freedom to select column width and thickness, steel grade, properties, strength, thickness, hardness and corrosive properties, and then making it easy to adapt the standard designs to suit the customised requirement, the engineer, designer or architect is given the freedom to design the concrete filled steel column structural element (30) according to the needs of the overall design and not based on what tube sizes, shapes, wall thicknesses and steel grades are available in the market at the time.

Figure 10A:
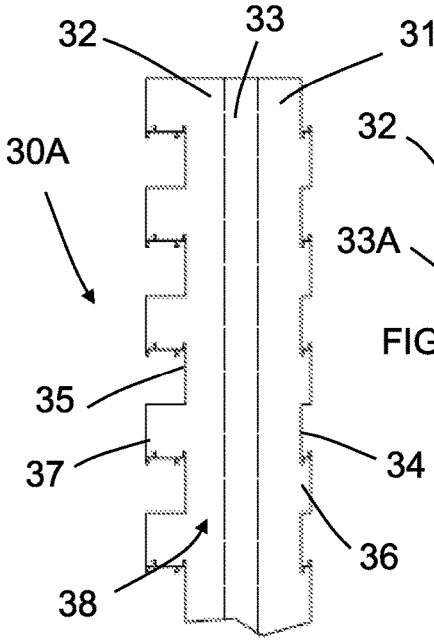
FIG. 10 indicates graphically that to form a square ended rib in the structural element of FIG. 12, the bending pattern requires two bending lines of 90 degrees each, with FIG. 10A indicating a plan view of the cutting lines on the sheet, FIG. 10B indicating an end view of the bent component, FIG. 10C indicating an exploded end view of four components before they are interconnected, and FIG. 10D indicating an end view of the four panels of FIG. 10C once they have been connected.
Figure 10B:
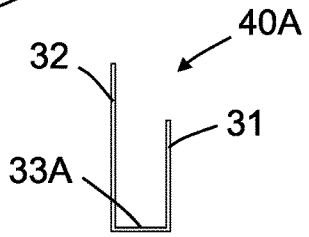
Figure 10C:
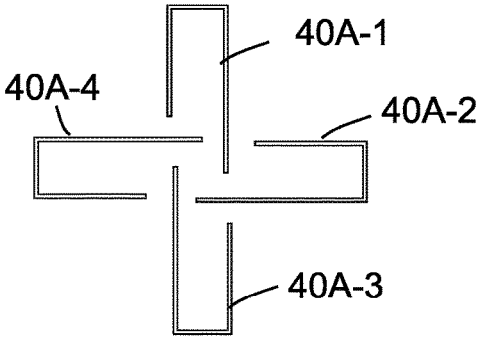
Figure 10D:
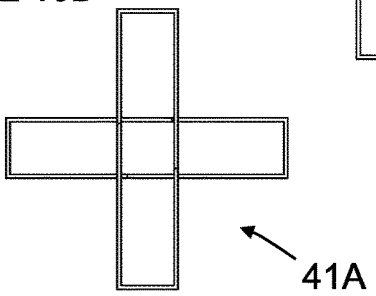
Figure 11A:
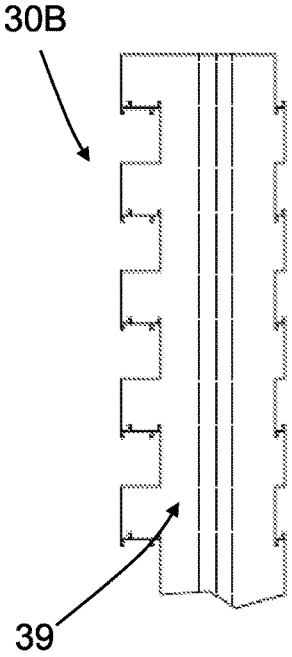
FIG. 11 indicates graphically that to form a triangular ended rib in the structural element of FIG. 12, the bending pattern requires three bending lines, one of 90 degrees in the middle and two of 45 degrees each, one on either side of the central bending line, with FIG. 11A indicating a plan view of the cutting lines on the sheet, FIG. 11B indicating an end view of the bent component, FIG. 11C indicating an exploded end view of four components before they are interconnected, and FIG. 11D indicating an end view of the four panels of FIG. 11C once they have been connected.
Figure 11B:
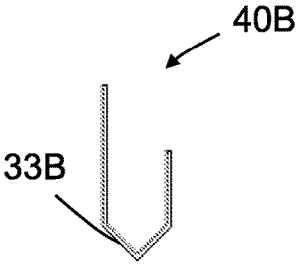
Figure 11C:
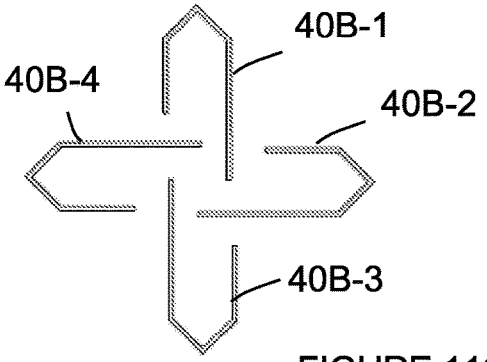
Figure 11D:
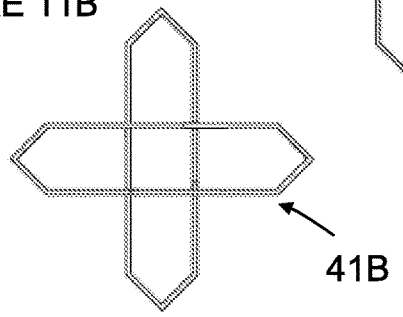

Each elongate component (30A, 30B) is then bent on the bend lines indicated on the sheet, in FIGS. 10A and 11A respectively, to transform the flat cut sheets (38, 39) into component panels (40A, 40B), as shown in FIGS. 10B and 11B. The components panels (40A, 40B) are then aligned as shown in FIGS. 100 and 110 respectively before being interlocked into the assembled structural elements (41A, 41B) as shown in FIGS. 10D and 11D.

Figure 12:
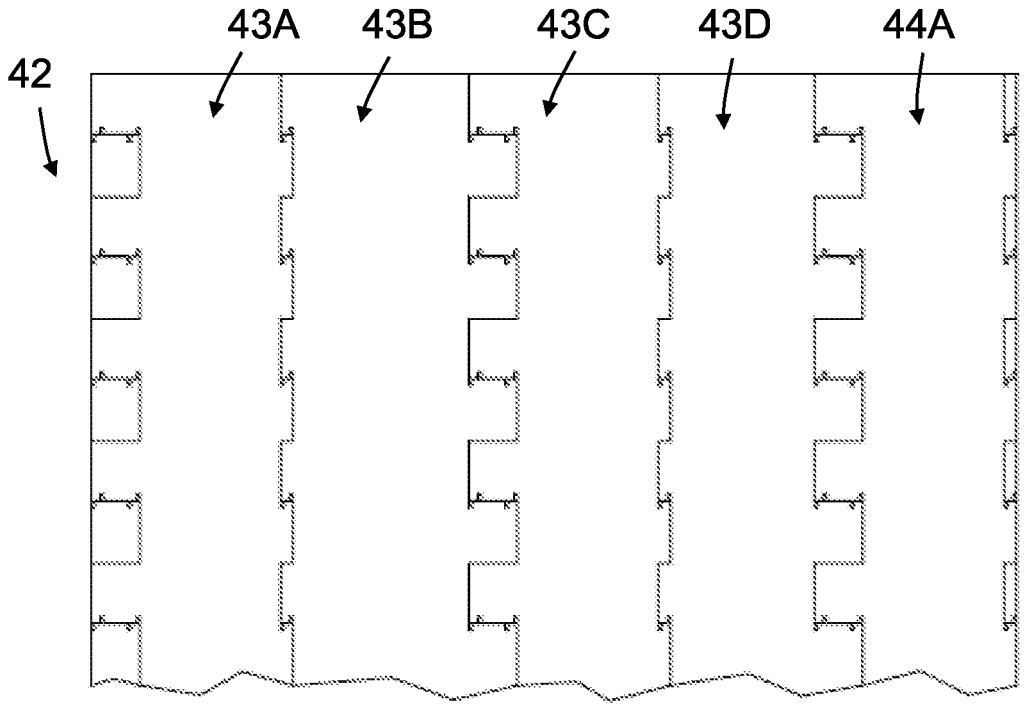
FIG. 12 indicates graphically the standard sheet metal cutting pattern for the structural element of a second embodiment of a structural element according to the invention, in the form of an X-shaped concrete filled steel column ("XCFC column") which is easy to manage by widening the distance between the cutting lines.

In this second embodiment of the structural element (30) the components are cut from metal sheet (42), along cut lines as for example indicated in FIG. 12. The sheet (42) in FIG. 12 has a repeating pattern of four components, with a first set of four components (43A-D) followed by a second set of four components (44), of which only the first (44A) is shown in FIG. 12. The flat panels shown in FIGS. 10A and 11A are formed by cutting it sheet along the cut lines, similar to that shown in FIG. 12.

Figure 13A:
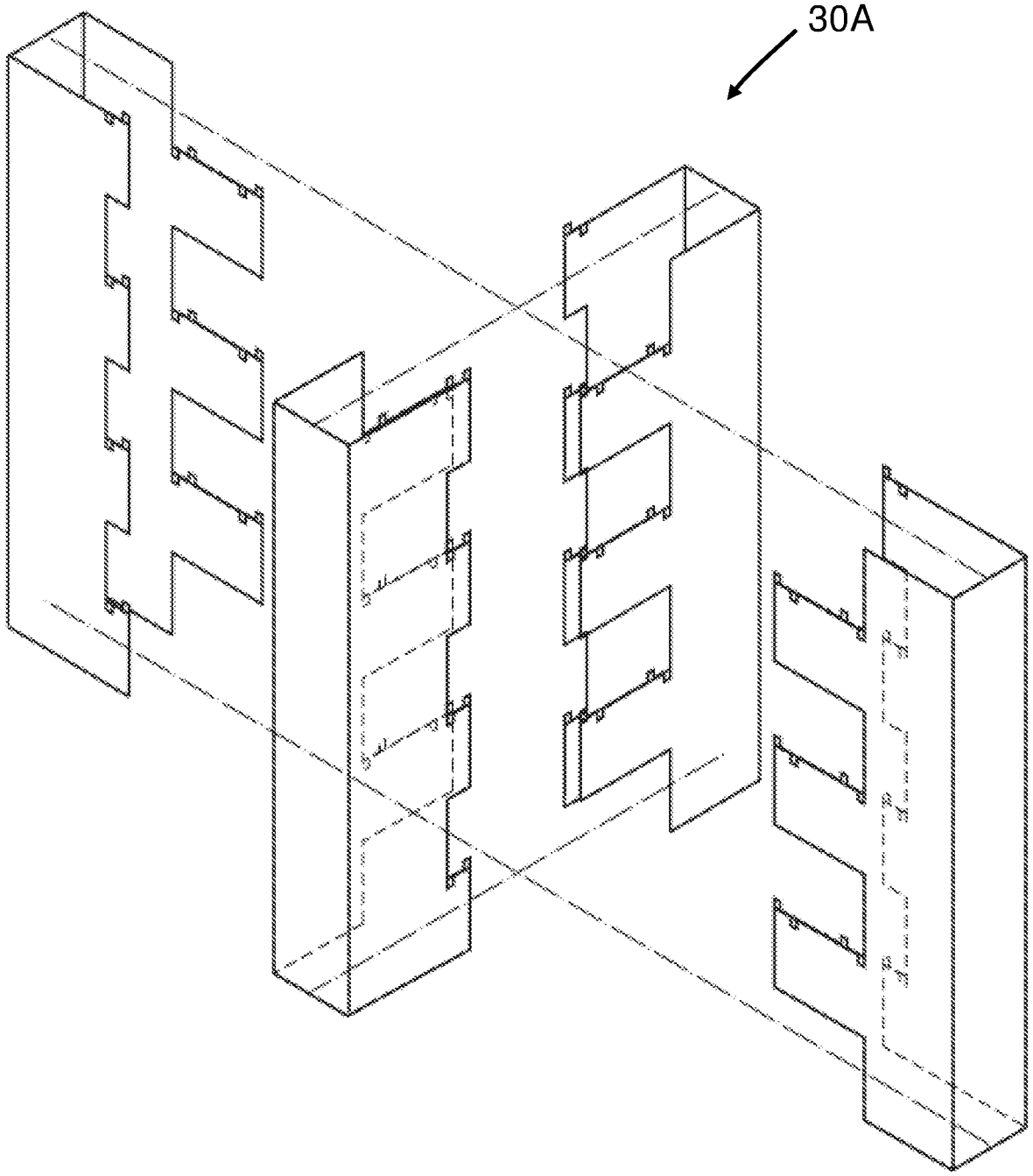
FIG. 13 is a part sectional view with exploded detail indicating the interaction between the tabs and slots of the structural element of FIG. 10, with FIG. 13A indicating an exploded perspective view of four components before they are interconnected, FIG. 13B indicating two opposing components placed in position for joining, and FIG. 13C indicating all four components joined together.
Figure 13B:
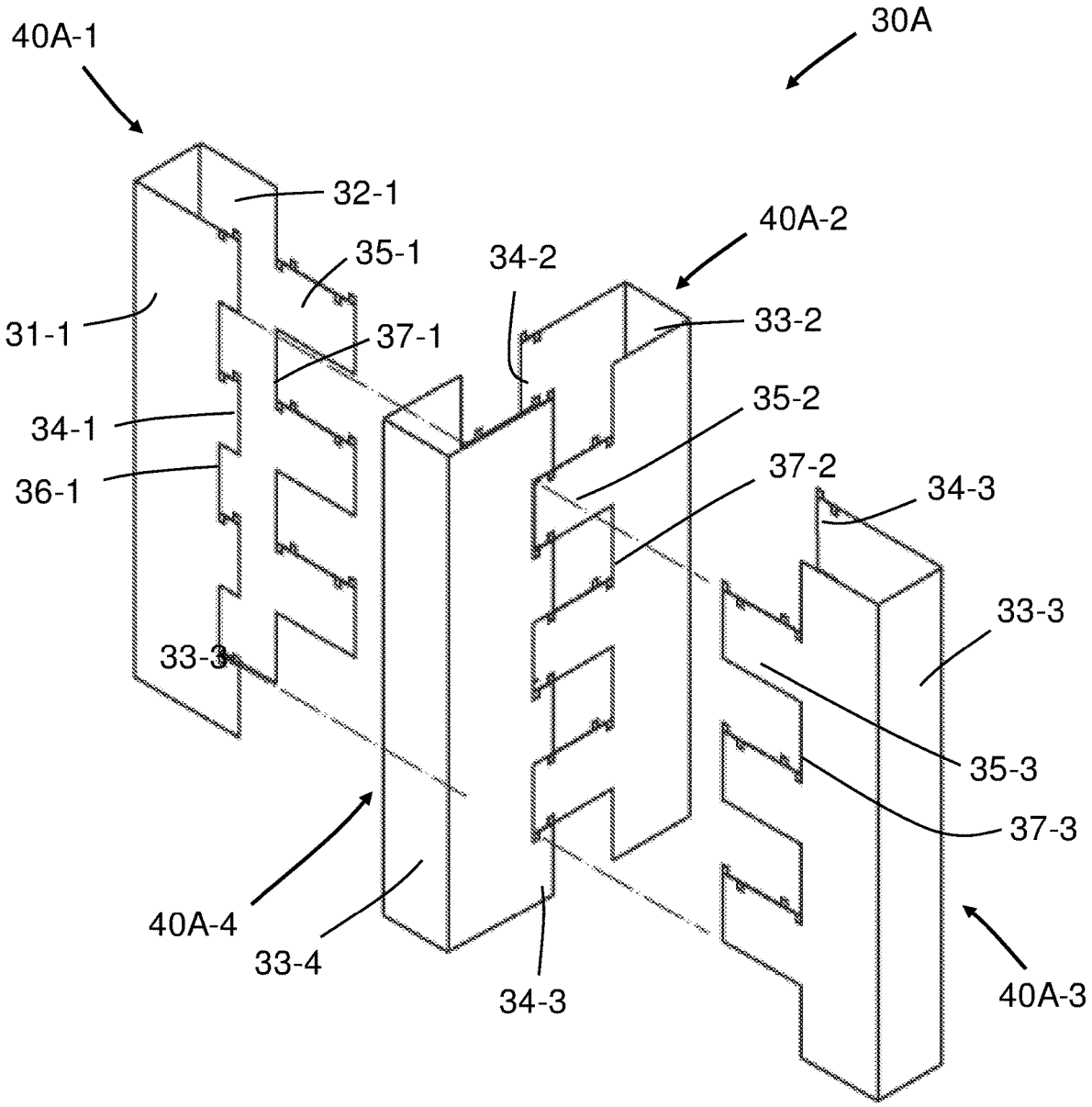
Figure 13C:
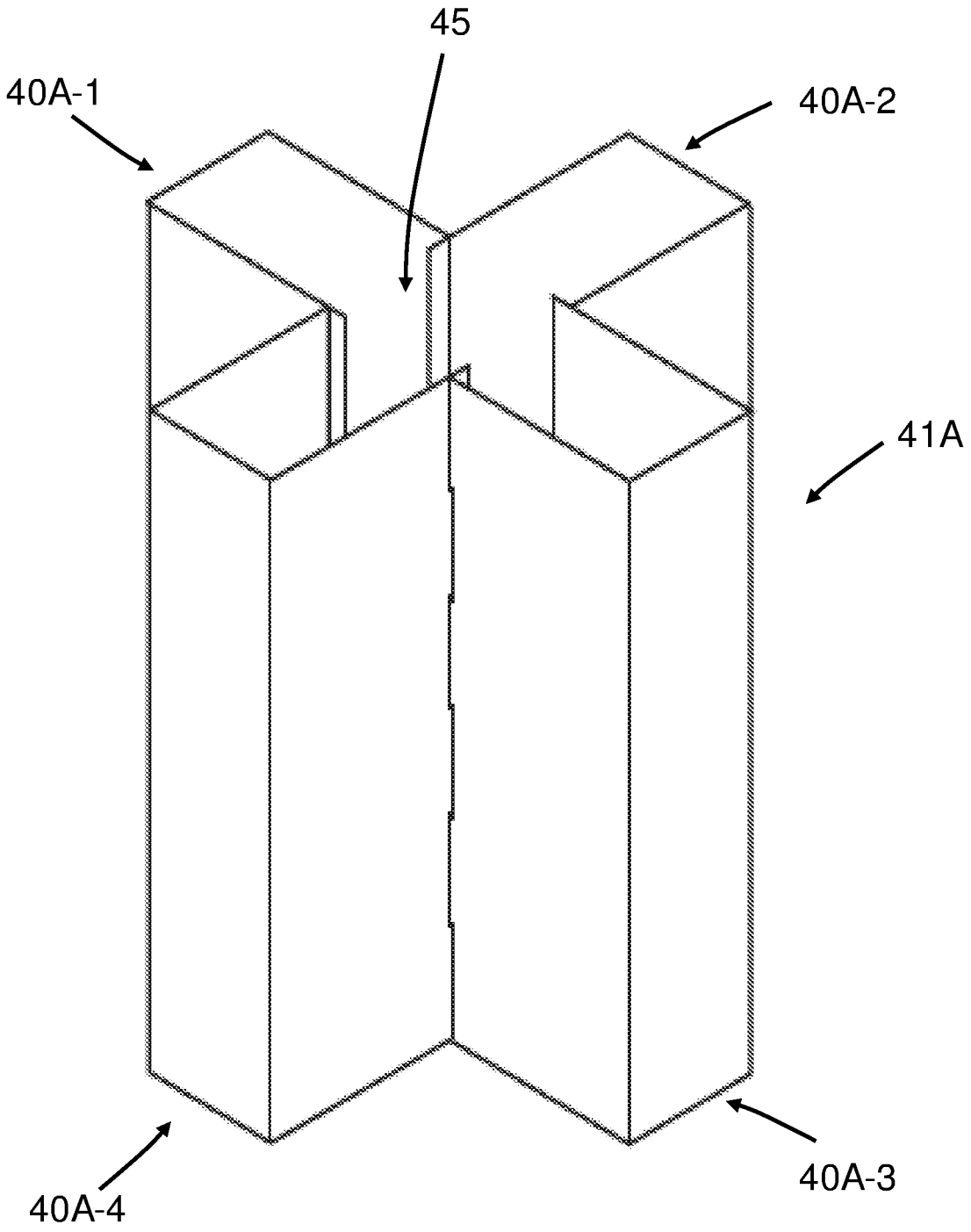

The assembly mentioned above with reference to FIGS. 10C-D and 11C-D are described in more detail below with reference to FIGS. 13A to 13C, in which the square ended components of FIG. 10 are used. In this assembly:

- the second extension tabs (35-1) of the first sheet component (40A-1) extend at right angles through and are interlocked with the first extension slots (34-2) of the second sheet component (40A-2);
- the second extension tabs (35-2) of the second sheet component (40A-2) extend at right angles through and are interlocked with the first extension slots (34-3) of the third sheet component (40A-3);
- the second extension tabs (35-3) of the third sheet component (40A-3) extend at right angles through and are interlocked with the first extension slots (34-4) of the fourth sheet component (40A-4);
- and the second extension tabs (35-4) of the fourth sheet component (40A-4) extend at right angles through and are interlocked with the first extension slots (34-1) of the first sheet component (40A-1).

Thus the four sheet components provide the structural element (41A) with an elongate open-ended core (45) with a plurality of elongate open-ended ribs (40A-1 to 40A-4) spaced around the core (45) with each rib (40A-1 to 40A-4) being longitudinally aligned with the core (45). The core (45) is in fluid communication with the interior of the ribs (40A-1 to 40A-4) through the second extension slots (37) between the spaced apart second extension tabs (35) that in assembly extend through the respective first extension slots (36).

The spaced apart second extension tabs (35), which are the longer of the tabs (34, 35), extend across the interior of the ribs (40A-1 to 40A-4), in each case adjacent the rib of which the specific second extension tabs (35) form part. For example, the second extension tabs (35-1) of the first sheet component (40A-1) extend across the interior of the rib forming part of the second sheet component (40A-2), and so on.

With the second extension tabs (35) of each sheet component being spaced apart the interior of the ribs are not isolated form the core (45). Concrete filled into the core also fills the ribs and vice versa. This allows concrete poured into the structural element (41A) to bind the ribs (40A-1 to 40A-4) and the core (45) together, significantly improving its strength without requiring additional reinforcing members that extend into the concrete.

A further feature is shown in FIGS. 10 to 14, and this relates to nibs (50, 52, 54) and cuts (51, 53, 55) on the tabs (34, 35). As shown in detail in FIG. 14, each first extension tab (34) is provided with a nib (50) proximate its edge which projects partly over the adjacent slot (36), and a complimentary sized cut (51) proximate the base of the adjoining slot (36). Each second extension tab (35) is provided with a nib (52) and a cut (53) set proximate its edge and another nib (54) and a cut (55) set adjacent the base of an adjoining slot (37).

In assembly, the nibs (50, 52, 54) and cuts (51, 53, 55) of the respective tabs (34, 35) and slots (36, 37) engage with opposing cuts and nibs, the further secure the respective bent sheet components together.

Figure 14:
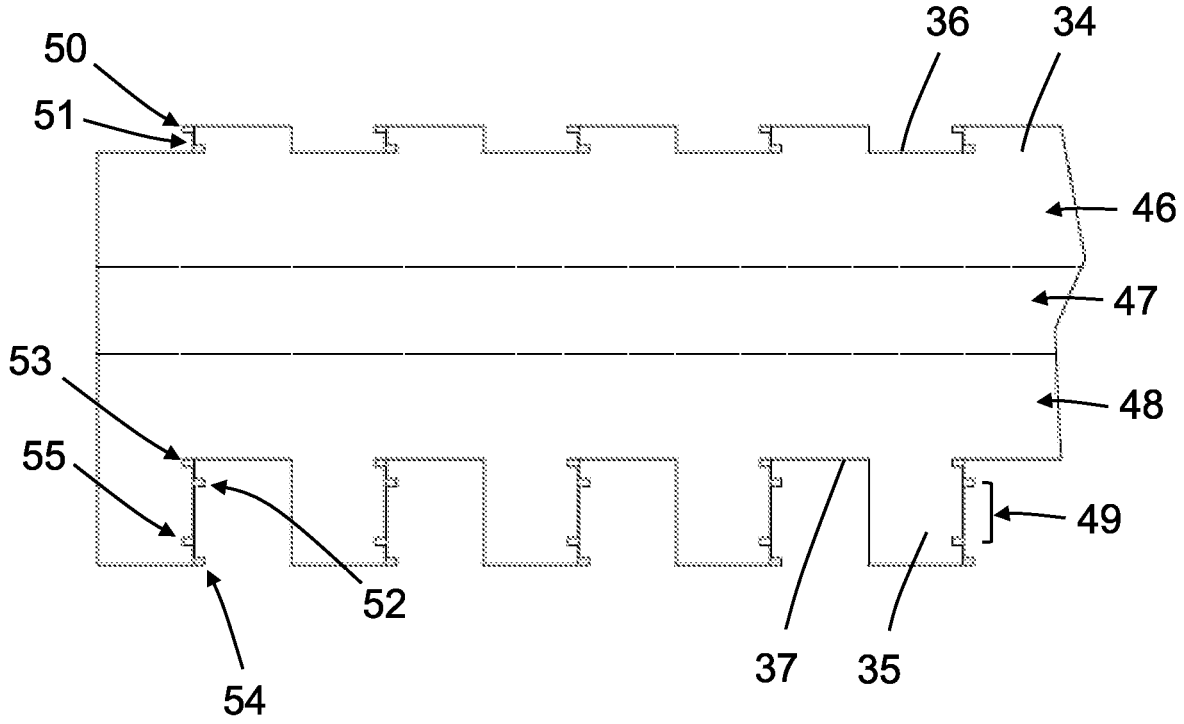
FIG. 14 indicates four critical bending sections must be adhered when cutting and bending the sheet in order for the sheet components to fit together.

FIG. 14 indicates four critical bending sections must be adhered when cutting and bending the sheet in order for the sheet components to fit together. These include the width (46) of the first extension, the width (48) of the second extension, and the width between the inner nib (52) and outer cut (55) on the second extension tabs (35) which must be equal to the width of the base (47).

This structural elements (1, 30) according to the invention thereby overcome the problems or concerns associated with CFSTs:

1) Unlike with a CFST, in this invention the steel binds to the concrete, enabling the composite structure to adhere and act as a single structure;
2) Pre-cut sheet metal plate components can be packed tightly for improved density to lower transportation cost to site where it can be assembled and the concrete can be added;
3) Easy and cost effective custom design of a concrete filled steel column structural element (1, 30) is made possible with the structural element (1, 30) of the invention;
4) Binding of the four components with each other and with the concrete happens as a result of solidifying a steel interlocking mechanism with concrete, so bolts and welding and other forms of costly and risky binding are not required;
5) An attachment piece to attach other objects or structures to the structural element (1, 30) and that is as strong as the structural element (1, 30) while binding and adhering to both the steel and concrete parts of the structural element (1, 30) without weakening either the attachment piece or the structural element (1, 30) is made possible by interweaving the attachment piece to the concrete and steel core and interlocking slots.

Although steel and concrete is used in the preferred embodiments of the structural element (1, 30) of the invention, the steel can be replaced by a different solid sheet based material such as plastics, plastic compounds, titanium, aluminium and others, and even be moulded into the described shape as opposed to being cut and bent, if required. Similarly, the concrete can be replaced by another solidifying compound such as a glue, epoxy, foam, plastic, nylon and others.

The structural element (1, 30) of the invention can be used in the construction industry in any suitable structure where high strength pillars, beams, supports, columns or plinths are required such as for bridges, high rise buildings, warehouses and other buildings, high lighting supports (streetlights), aerial guideways and causeways (transportation tracks and power cables), towers and others. As has been proven by studies done on CFSTs, the combined properties of steel and concrete makes the overall structure much stronger than either a concrete or steel column would be on its own, and by enabling low cost manufacturing and the freedom to customise, engineers, designers and architects are given a range of cost effective tools to optimise structure design. By pre-manufacturing the columns to specification and assembling on site, thereby doing away with on-site formwork, inspections and curing time, construction cost and time can be saved.

In construction where columns, beams or pillars are required, the structural element (1, 30) of the invention gives engineers, designers and architects and builders the benefits of much improved strength, ease of customisation, lower cost manufacturing, lower cost construction and reduced construction time.

Where required, to further facilitate bonding of the concrete with the steel sheet, the sheet from which each component of the structural element (1, 30) is formed can be scoured or roughened up before it is cut.

The structural element (1, 30) of the invention can be used to easily and cost effectively custom design and manufacture a super strong concrete filled steel beam or pillar to the specifications that is required for the specific project such as the construction of a multi storey building.

It will be appreciated that the embodiments described above are given by way of example only and are not intended to limit the scope of the invention. Modifications to these embodiments are possible without departing from the essence of the invention.

The invention claimed is:

1. A structural element, comprising:

a plurality of interlocked resilient sheet material components, each of the plurality of interlocked resilient sheet material components operatively forming a component of the structural element by being shaped to provide an elongate base with two opposing edges from which a first extension and a second extension respectively extend, with the second extension extending further from the elongate base than the first extension;

wherein the first and second extensions are provided with complimentary interlocking means operatively enabling the extensions of one of the plurality of interlocked resilient sheet material components to be interlocked with the extensions of another sheet material component of the plurality of interlocked resilient sheet material components;

wherein the first and second extensions of four sheet components of the plurality of interlocked resilient sheet material components being interlocked, each at a right angle with at least one extension of another one of the plurality of interlocked resilient sheet material components;

wherein operatively for the four sheet components of the plurality of interlocked resilient sheet material components to provide the structural element with an elongate open-ended core with a plurality of elongate open-ended ribs spaced around the elongate open-ended core with each of the plurality of elongate open-ended ribs being longitudinally aligned with the elongate open-ended core.

2. The structural element of claim 1 wherein:

the second extension of a first sheet component of the plurality of interlocked resilient sheet material components is interlocked with and extending at right angles beyond the first and second extensions of a second sheet component of the plurality of interlocked resilient sheet material components;

the second extension of the second sheet component being interlocked with and extending at right angles beyond the second and first extensions of the first sheet component, and with the first extension of the second sheet component being interlocked with and extending at right angles beyond the second extension of the first sheet component and the first extension of a third sheet component of the plurality of interlocked resilient sheet material components;

the first extension of the third sheet component being interlocked with and extending at right angles beyond the first extension of the second sheet component and the second extension of a fourth sheet component of the plurality of interlocked resilient sheet material components, and with the second extension of the third sheet component being interlocked with and extending at right angles beyond the second and first extensions of the fourth sheet component; and the second extension of the fourth sheet component being interlocked with and extending at right angles beyond the second and first extensions of the third sheet component, and with the first extension of the fourth sheet component being interlocked with and extending at right angles beyond the second extension of the third sheet component and the first extension of a first sheet component.

3. The structural element of claim 2 wherein:

each of the plurality of elongate open-ended ribs has a height that is variable by varying lengths of the first and second extensions of the respective sheet component of the plurality of interlocked resilient sheet material components; and the elongate open-ended rib has a width that is variable by varying a length of the elongate bases of opposing sheet components of the plurality of interlocked resilient sheet material components.

4. The structural element of claim 1 wherein:

each of the first and the second extensions terminates in an edge provided with a series of spaced apart tabs and slots, with the tabs of the first extension being located longitudinally opposite the slots of the second extension and with the tabs of the second extension being located longitudinally opposite the slots of the first extension, and with the tabs of the second extension being longer than the tabs of the first extension for the second extension to extend further from the elongate base than the first extension;

the second extension tabs of a first sheet component of the structural element extending at right angles through and interlocked with the first extension slots of a second sheet component of the structural element;

the second extension tabs of the second sheet component of the structural element extending at right angles through and interlocked with the first extension slots of a third sheet component of the structural element;

the second extension tabs of the third sheet component of the structural element extending at right angles through and interlocked with the first extension slots of a fourth sheet component of the structural element;

the second extension tabs of the fourth sheet component of the structural element extending at right angles through and interlocked with the first extension slots of the first sheet component of the structural element; and operatively for the four sheet components to provide the structural element with an elongate open-ended core with a plurality of elongate open-ended ribs spaced around the elongate open-ended core with each rib being longitudinally aligned with the elongate open-ended core, and with the elongate open-ended core being in fluid communication with the interior of the ribs by the spaces between the spaced apart second extension tabs extending through the respective first extension slots.

5. The structural element of claim 4 wherein the extension tabs of the second extension is about as long but no longer than a width of the elongate base of the sheet material component through which slots it is operatively extended and interlocked with.

6. The structural element of claim 1 wherein the elongate open-ended core and the plurality of elongate open-ended ribs are filled with a filler material.

7. The structural element of claim 6 wherein:

the plurality of interlocked resilient sheet material components include a resilient material including steel; and the filler material includes concrete.

8. The structural element of claim 1 wherein the elongate open-ended core and the plurality of elongate open-ended ribs are filled with a cementitious filler.

9. The structural element of claim 1 wherein the elongate open-ended core is shaped in the form of a column, each of the plurality of elongate open-ended ribs includes a column including a right square column or a right rectangular column.

10. The structural element of claim 9 wherein the column includes a right square column.

11. The structural element of claim 1 wherein the interlocking means includes one or more of a slot, welding, riveting, gluing, encircling securing members, or retaining members extending through opposing sheet material components of the plurality of interlocked resilient sheet material components.

* * * * *